US009752269B2

(12) United States Patent
Kim et al.

(10) Patent No.: US 9,752,269 B2
(45) Date of Patent: Sep. 5, 2017

(54) WASHING MACHINE AND ASSEMBLY METHOD THEREOF

(71) Applicant: SAMSUNG ELECTRONICS CO., LTD., Suwon-si, Gyeonggi-do (KR)

(72) Inventors: Kyoung Sup Kim, Suwon-si (KR); Jong Gun Kim, Hwaseong-si (KR); Moon Jong Kim, Seoul (KR); Hyun Gyu Kim, Seoul (KR); Young Seong Cheon, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 451 days.

(21) Appl. No.: 14/487,615

(22) Filed: Sep. 16, 2014

(65) Prior Publication Data

US 2015/0121972 A1 May 7, 2015

(30) Foreign Application Priority Data

Nov. 7, 2013 (KR) ..... 10-2013-0134782

(51) Int. Cl.
*D06F 39/00* (2006.01)
*D06F 39/14* (2006.01)
(Continued)

(52) U.S. Cl.
CPC ..... *D06F 39/005* (2013.01); *D06F 37/267* (2013.01); *D06F 39/12* (2013.01);
(Continued)

(58) Field of Classification Search
CPC ..... D06F 39/12; D06F 39/14; D06F 39/005; D06F 37/267; D06F 23/04; Y10T 29/49169
See application file for complete search history.

(56) References Cited

U.S. PATENT DOCUMENTS 3,970,354 A * 7/1976 Hopkins ..... H01R 13/629 439/292
4,006,959 A * 2/1977 Hopkins ..... H01R 4/2441 439/489
(Continued)

FOREIGN PATENT DOCUMENTS

KR 2006013831 A1 * 2/2006

OTHER PUBLICATIONS

Machine Translation of KR 2006013831 to Kim, Feb. 2006.*

*Primary Examiner* — Michael Barr
*Assistant Examiner* — Benjamin L Osterhout
(74) *Attorney, Agent, or Firm* — Staas & Halsey LLP

(57) ABSTRACT

A washing machine includes a casing, a tub installed within the casing, a cover coupled to the top of the casing and having an opening for introduction of laundry, a control panel attached to the cover to enable selection of a washing mode, and a lower electric component located below the tub, such as a drive device. The washing machine may be manufactured to further include an integrated wire harness having one side coupled to the control panel and the other side coupled to the lower electric component for transmission of an electrical signal, and a guide provided at an upper edge of the casing such that the wire harness is fixed to and extends along the guide. The integrated wire harness may achieve reduction of manufacturing costs and prevent fire of the washing machine due to insulation breakage.

22 Claims, 6 Drawing Sheets

(51) Int. Cl.

| | |
|---|---|
| ***H02G 1/06*** | (2006.01) |
| ***D06F 37/26*** | (2006.01) |
| ***D06F 39/12*** | (2006.01) |
| *D06F 23/04* | (2006.01) |

(52) U.S. Cl.
CPC ..... *D06F 39/14* (2013.01); *D06F 23/04* (2013.01); *Y10T 29/49169* (2015.01)

(56) References Cited

U.S. PATENT DOCUMENTS

| | | | | |
|---|---|---|---|---|
| 4,050,764 | A * | 9/1977 | Hopkins | H01R 4/2416 439/465 |
| 5,726,402 | A * | 3/1998 | Katz | H01H 9/226 200/61.62 |
| 5,887,456 | A * | 3/1999 | Tanigawa | D06F 25/00 34/596 |
| 2004/0144136 | A1* | 7/2004 | Mae | D06F 33/02 68/12.19 |
| 2005/0132759 | A1* | 6/2005 | Guinibert | D06F 58/04 68/24 |
| 2005/0274154 | A1* | 12/2005 | Johnson | D06F 39/12 68/3 R |
| 2012/0023679 | A1* | 2/2012 | Hettinger | D06F 35/006 8/137 |
| 2012/0314348 | A1* | 12/2012 | Moncrieff | H05K 5/0017 361/679.01 |
| 2013/0042653 | A1* | 2/2013 | Acharya | D06F 39/02 68/12.18 |

* cited by examiner

WASHING MACHINE AND ASSEMBLY METHOD THEREOF

CROSS-REFERENCE TO RELATED APPLICATIONS

This application claims the benefit of Korean Patent Applications No. 10-2013-0134782, filed on Nov. 7, 2013 in the Korean Intellectual Property Office, the disclosure of which is incorporated herein by reference.

BACKGROUND

1. Field

Embodiments disclosed herein relate to a washing machine having an integrated wire harness and an assembly method of the washing machine.

2. Description of the Related Art

In general, a washing machine refers to an apparatus that washes laundry via agitation of wash water and laundry. Types of washing machines may include a horizontal-axis washing machine and a vertical-axis washing machine. The horizontal-axis washing machine washes laundry as laundry is lifted upward and drops along an inner circumferential surface of a rotating tub when the horizontally oriented rotating tub is rotated forward or in reverse about a horizontal axis. On the other hand, the vertical-axis washing machine generally contains a pulsator therein and washes laundry using a water stream generated by the pulsator.

In an operation of the above described vertical-axis washing machine, the pulsator may be located at a lower position and may be rotated in response to a signal input from a control panel located at an upper position. To transmit an input signal of the control panel to each electric component including, e.g., the pulsator for operation of the washing machine, a wire harness may be provided to connect the control panel and the electric component to each other.

In the case of a front control type washing machine in which a control panel may be located at an upper portion of a front surface of the washing machine, typically, a main wire coupled to the control panel and a sub wire coupled to, e.g., a motor located at a lower position are coupled to each other using a connector. Although this wire coupling using the connector may exhibit good assembly efficiency, there is a risk of invasion of moisture into the connector.

For example, if hot steam is introduced into the washing machine and invades the connector during operation of the washing machine, tracking between both poles may occur. Such tracking breaks insulation of the connector and generates extreme heat, and thus there is a risk of an accident (e.g., a fire) when the extreme heat is transferred to the entire washing machine. Although research on a waterproof cover surrounding the connector to prevent invasion of moisture is being conducted, this increases manufacturing costs and is not a fundamental method of preventing invasion of moisture.

SUMMARY

It is an aspect of the disclosure to provide a front control type washing machine having an integrated wire harness.

It is another aspect of the disclosure to provide a washing machine having an integrated wire harness and a guide for enhancement of assembly efficacy, and an installation method of the washing machine using the guide.

Additional aspects of the disclosure will be set forth in part in the description which follows and, in part, will be apparent from the description, or may be learned by practice of the disclosure.

In accordance with an aspect of the disclosure, a washing machine may include a casing, a tub installed within the casing, a cover coupled to the top of the casing, the cover having an opening for introduction of laundry, a control panel attached to a front surface of the cover to enable selection of a washing mode, a lower electric component located below the tub, the lower electric component including a drive device, an integrated wire harness having one side coupled to the control panel and the other side coupled to the lower electric component for transmission of an electrical signal, and a guide provided at an upper edge of the casing such that the wire harness is fixed to and extends along the guide.

An upper electric component including a water supply device may be located in a rear region of the cover, the control panel may include an input unit (e.g., an array of buttons and/or knobs) located at a front surface thereof and a circuit board located at a rear surface thereof to control operation of the washing machine via manipulation of the array of buttons, and one side of the wire harness, the other side of which is coupled to the lower electric component, may include a first wire coupled to the upper electric component and a second wire coupled to the circuit board.

The cover may include a first opening formed at the rear side of the opening such that the first wire is coupled to the upper electric component through the first opening, and a second opening formed at the front side of the opening such that the second wire is coupled to the control panel through the second opening.

The wire harness, the other side of which is coupled to the lower electric component, may extend to the top of the casing, and the casing may include a holder configured to (suitable for, capable of, adapted to, arranged to, operable to, etc.) fix the extending wire harness to an upper portion of an inner surface of the casing.

The wire harness, fixed to the holder to extend upward, may be divided (e.g., may contain a plurality of wires) into the first wire and the second wire, and the first wire may pass through the first opening to thereby be coupled to the upper electric component, and the second wire may extend along the guide and passes through the second opening to thereby be coupled to the control panel.

The guide may be installed to an edge of the casing coupled to the cover.

The guide may define an elongated groove, into which the wire harness is inserted to extend along the guide.

The guide may include at least one fixing member configured to (suitable for, capable of, adapted to, arranged to, operable to, etc.) fix the wire harness inserted into the elongated groove.

The guide may include at least one fitting member located at a lower surface of the guide to install the guide to the casing.

The casing may include at least one fitting recess formed in an upper corner of the casing such that the at least one fitting member is inserted into the fitting recess.

In accordance with an aspect of the disclosure, a washing machine may include a casing defining a box-shaped external appearance having an open top side, a cover coupled to cover the top side of the casing, the cover having a pivotally rotatably coupled door, and a guide attached to an edge of the top side of the casing so as to be covered with the cover, the guide defining a passage through which an electric wire extends.

The cover may include a first opening formed at the rear side of the door so as to be located proximate to one side of the guide, and a second opening formed at the front side of the door so as to be located proximate to the other side of the guide.

The washing machine may further include a tub in which laundry is received, the tub being installed within the casing, and a wire harness having one side coupled to a lower surface of the tub and the other side extending to one side of the guide proximate to the first opening.

The wire harness may include a first wire passing through the first opening and a second wire extending along the guide and passing through the second opening.

The guide may include at least one fixing member to fix the second wire, extending along the guide, to the guide.

The guide may include fitting members provided at both sides thereof and configured to be (suitable for, capable of, adapted to, arranged to, operable to, etc.) fitted into the casing, and fitting recesses may be formed in an edge of the top side of the casing such that the fitting members are inserted respectively into the fitting recesses.

In accordance with an aspect of the disclosure, an assembly method of a washing machine, the washing machine including a casing defining an external appearance of the washing machine, and a tub in which laundry is received, may include connecting one side of a wire harness to a lower electric component installed to a lower surface of the tub, installing the tub within the casing through an open top side of the casing, extending the wire harness, connected to the lower electric component, to the top of the casing, and then extending the wire harness to a front surface of the casing along a guide installed at an edge of the top side of the casing, coupling a cover having an opening for introduction of laundry to the top side of the casing, and coupling the other side of the wire harness, extending to the front surface of the casing, to a control panel located at the cover.

The wire harness, extending from the lower electric component to the top of the casing, may be fixed to the top of a rear surface of the casing.

The wire harness, fixed to the top of the rear surface of the casing, may be divided into (e.g., may include) a first wire coupled to an upper electric component located in a rear region of the cover, and a second wire extending to the front surface of the casing along the guide.

The wire harness, extending to the front surface of the casing along the guide, may be fixed to the guide via at least one fixing member installed to the guide.

The guide may include at least one fitting member, and the at least one fitting member may be fitted into at least one fitting recess formed in the edge of the top side of the casing to install the guide to the edge of the top side of the casing.

In accordance with an aspect of the disclosure, a washing machine may include a casing, a tub disposed in the casing, a control panel disposed above the tub to control an operation of the washing machine, a lower electric component disposed below the tub, and a wire harness including at least one connector-free wire which is connected to the lower electric component at one end, and connected to the control panel at the other end.

The washing machine may further include a guide which extends in a front-to-back direction of the washing machine along an upper edge of the casing. The guide may include a channel having a bottom surface in which the wire harness is seated upon, and lateral sides bent upward from the bottom surface to surround the wire harness. The guide may further include at least one fixing member formed of a flexible material which is attached to a lateral side of the guide and bent over an open top of the channel to secure the wire harness in the channel.

The washing machine may further include an upper electric component disposed above the tub at the back side of the washing machine, and the control panel may include a circuit board disposed at the front side of the washing machine. The at least one connector-free wire may be connected to the lower electric component at one end, and connected to the circuit board at the other end, via the guide, and the wire harness may include a second wire connected to the lower electric component at one end, and connected to the upper electric component at the other end.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
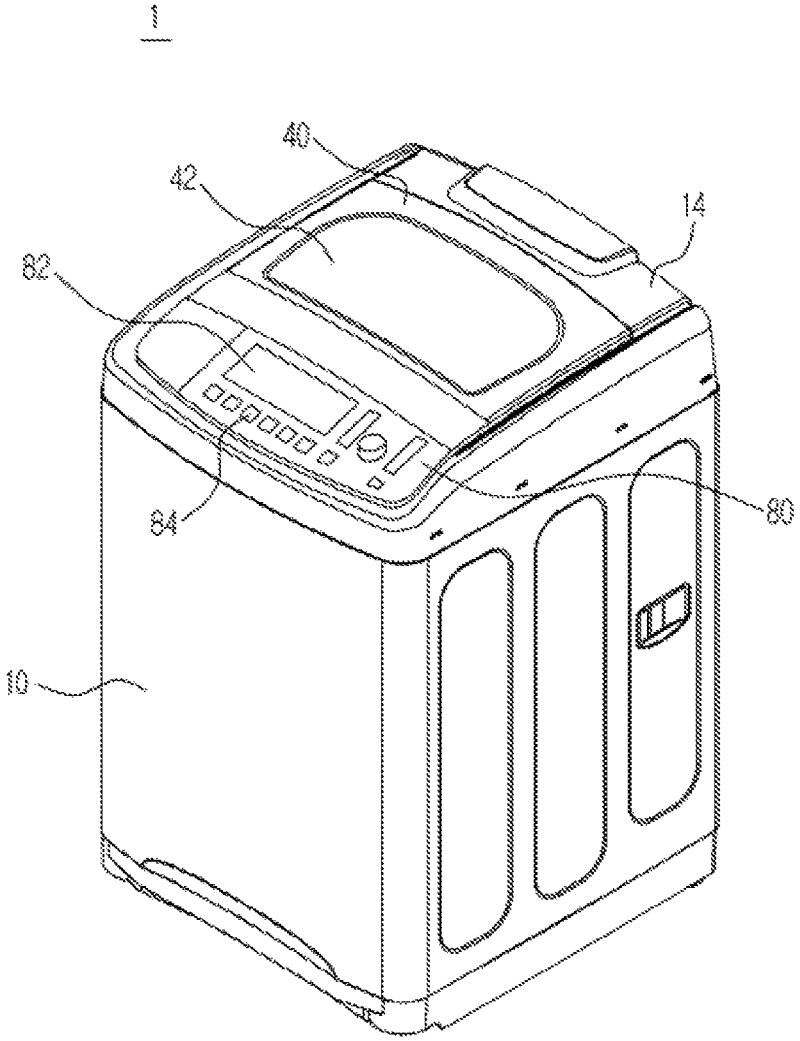
FIGS. 1 and 2 are views showing a washing machine according to an embodiment of the disclosure.

Reference will now be made in detail to embodiments of the disclosure, examples of which are illustrated in the accompanying drawings, wherein like reference numerals refer to like elements throughout.

Figure 2:
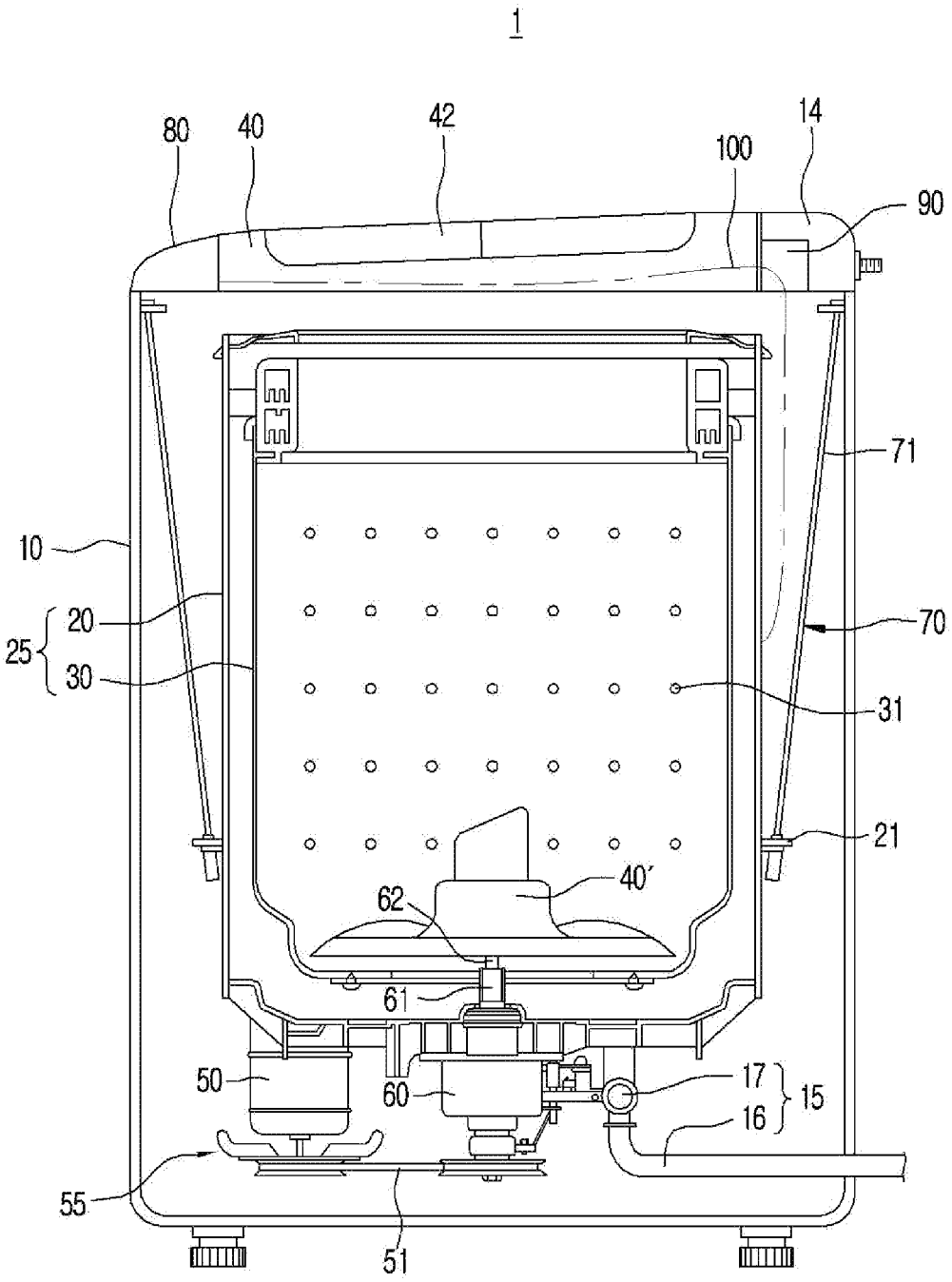

FIGS. 1 and 2 are views showing a washing machine 1 according to an embodiment of the disclosure.

The washing machine 1 may include a casing (or cabinet) 10 defining an external appearance of the washing machine 1, a water tub 20 installed within the casing 10 to receive wash water therein, and a washtub 30 rotatably installed within the water tub 20. The water tub 20 and the washtub 30 installed within the casing 10 constitute a tub structure 25.

The washing machine 1 may include a pulsator 40' rotatably mounted at the bottom of the washtub 30, and a drive motor 50 and a clutch device 60 which serve to drive the washtub 30 and the pulsator 40'. Electric components installed to a lower surface of the tub structure 25 including the drive motor 50 and the clutch device 60 are referred to as lower electric components 55.

The casing 10 may have a box-shaped external appearance having an open top side, and a cover 40 may be coupled to the open top side of the casing 10. The cover 40 may include a center opening (42*a*, see FIG. 6), through which a user may introduce laundry into or may retrieve laundry from the casing 10, and a door 42 may be installed to open or close the opening 42*a*.

A control panel 80 for control of the washing machine 1 may be provided at a front portion of the cover 40. An input unit 84 which enables or allows a user to input a command to select a washing mode and a display unit 82 to display an operating state of the washing machine 1 and a user manipulation state may be arranged at a front surface of the control panel 80. For example, an array of buttons (and/or knobs) 84 to allow the user to input a selected washing mode and a display unit 82 to display an operating state of the washing machine 1 and a user manipulation state may be arranged at a front surface of the control panel 80. The input unit may also include one or more other interface mechanisms to input a command (e.g., a switch, wireless controls, etc.) and may include a touchscreen. The display unit 82 may include a liquid crystal display (LCD), a light emitting diode (LED) display, an organic light emitting diode (OLED) display, active matrix organic light emitting diode (AMOLED), and the like. A circuit board 86 may be located at a rear surface of the control panel 80 to control one or more operations of the washing machine 1 based on manipulation of the array of buttons (and/or knobs) 84. The control panel and circuit board may include one or more processors. For example, a processing device may include, for example, one or more of a processor, a controller and an arithmetic logic unit, a central processing unit (CPU), a graphics processing unit (GPU), a digital signal processor (DSP), a microcomputer, a field programmable array, a programmable logic unit, an application-specific integrated circuit (ASIC), a microprocessor or any other device capable of responding to and executing instructions in a defined manner. In an alternative embodiment, the control panel 80 may be disposed in a location other than the front portion of the cover 40. For example, the control panel 80 may be disposed on a front surface of the washing machine 1, instead of a top surface of the washing machine 1. The control panel 80 may also be disposed at a rear portion of the cover 40 instead of a front portion of the cover 40. Alternatively, the control panel 80 may be disposed in a structure mounted on a top surface of the casing 10.

An electric-component receptor 14 for installation of various electric components related to operation of the washing machine 1 may be provided in a rear region of the cover 40. The electric-component receptor 14 may be a recessed rear region of the cover 40 in which electric components, such as a control device, a water supply valve, etc., may be installed. These electric components received in the electric-component receptor 14 are referred to as upper electric components 90.

A water supply device (not shown) may be installed to an upper lateral portion of the casing 10. A drain device 15 may include a drainpipe 16 and a drain valve 17. The drain device 15 may be installed to a lower lateral portion of the casing 10 to outwardly discharge wash water received in the water tub 20.

The water tub 20 may be centrally installed within the casing 10 to receive wash water through the water supply device (not shown). The water tub 20 may be a cylindrical tub in which wash water may be received, and wash water may be supplied into the water tub 20 through an open top side of the water tub 20. The drainpipe 16 may be connected to the bottom of the water tub 20 to outwardly discharge wash water received in the water tub 20. A plurality of fixing brackets 21 may be arranged on an outer periphery of a lower portion of the water tub 20. For example, the plurality of fixing brackets 21 may be arranged at a constant (regular) interval on an outer periphery of a lower portion of the water tub 20. One or more suspension devices 70, by which the water tub 20 is supported by the casing 10, may be coupled to the fixing brackets 21.

Typically, four suspension devices 70 may be provided to hang the water tub 20 from the casing 10 such that the water tub 20 is supported by the casing 10. Each of the suspension devices 70 may include a support rod 71 connecting the casing 10 and the water tub 20 to each other, and a damper (not shown) may be coupled to a lower end of the support rod 71 to absorb vibration of the water tub 20. An upper end of the support rod 71 may be fitted into a support rod receiver (72, see FIG. 3) formed at the top of the casing 10, and the lower end of the support rod 71 may be coupled to the fixing bracket 21.

The washtub 30 may be centrally installed within the water tub 20 to ensure stable rotation thereof, and may have a plurality of through-holes 31 through which wash water moves to the water tub 20. The washtub 30 may have an open top side for introduction of wash water and laundry. A dehydration shaft 61 may be coupled to the bottom of the washtub 30 and connected to the clutch device 60.

The pulsator 40' may be mounted to an inner bottom surface of the washtub 30 to generate a water stream. The pulsator 40' serves to agitate laundry introduced into the washtub 30 and wash water together, and may be rotatably installed at the bottom center of the washtub 30 while being supported by a washing shaft 62. For example, the pulsator 40' may be rotatable in both forward and reverse directions.

The drive motor 50 may be coupled to an outer lower surface of the water tub 20, and the clutch device 60, which receives power of the drive motor 50 via a drive belt 51, may be installed at the center of the outer lower surface of the water tub 20. The clutch device 60 may selectively rotate the dehydration shaft 61 and the washing shaft 62. In addition, the clutch device 60 may serve as a brake to reduce a rate of rotation of the pulsator 40' and to stop rotation of the washtub 30.

The entire washing process of the washing machine 1 and operation of respective components will hereinafter be described. Laundry may be introduced into the washtub 30 and wash water and detergent may be supplied into the water tub 20. Thereafter, drive power of the drive motor 50 may be transmitted to the washing shaft 62 through the clutch device 60, thereby causing the pulsator 40' to be rotated. Through rotation of the pulsator 40', laundry and wash water within the washtub 30 may be agitated to achieve washing of laundry. After completion of washing, the wash water received in the water tub 20 may be outwardly discharged through the drainpipe 16 and only wet laundry remains in the washtub 30. Then, as drive power of the drive motor 50 is transmitted to the dehydration shaft 61 through the clutch device 60 to rotate the washtub 30, moisture of laundry may be discharged by centrifugal force.

The above described operation of the washing machine 1 may be implemented as a result or consequence of (i.e., in response to) an electrical signal input from the control panel 80. The electrical signal may be transmitted to one or more electric components, such as the drive motor 50, etc. Accordingly, the respective components of the washing machine 1 may be connected to one another via electric wires for transmission and reception of an electrical signal. A bundle of the electric wires is referred to as a wire harness 100. The wire harness 100 may apply an electrical signal to a respective electric component to operate the respective electric component.

As exemplarily shown in FIG. 2, one side of the wire harness 100 may be coupled to the control panel 80 and the other side of the wire harness 100 may be coupled to the lower electric component 55 for transmission of an electrical signal. That is, the wire harness 100 integrally connects the control panel 80 and the lower electric component 55 to each other via a single wire without a separate connection structure, such as a connector.

Figure 3:
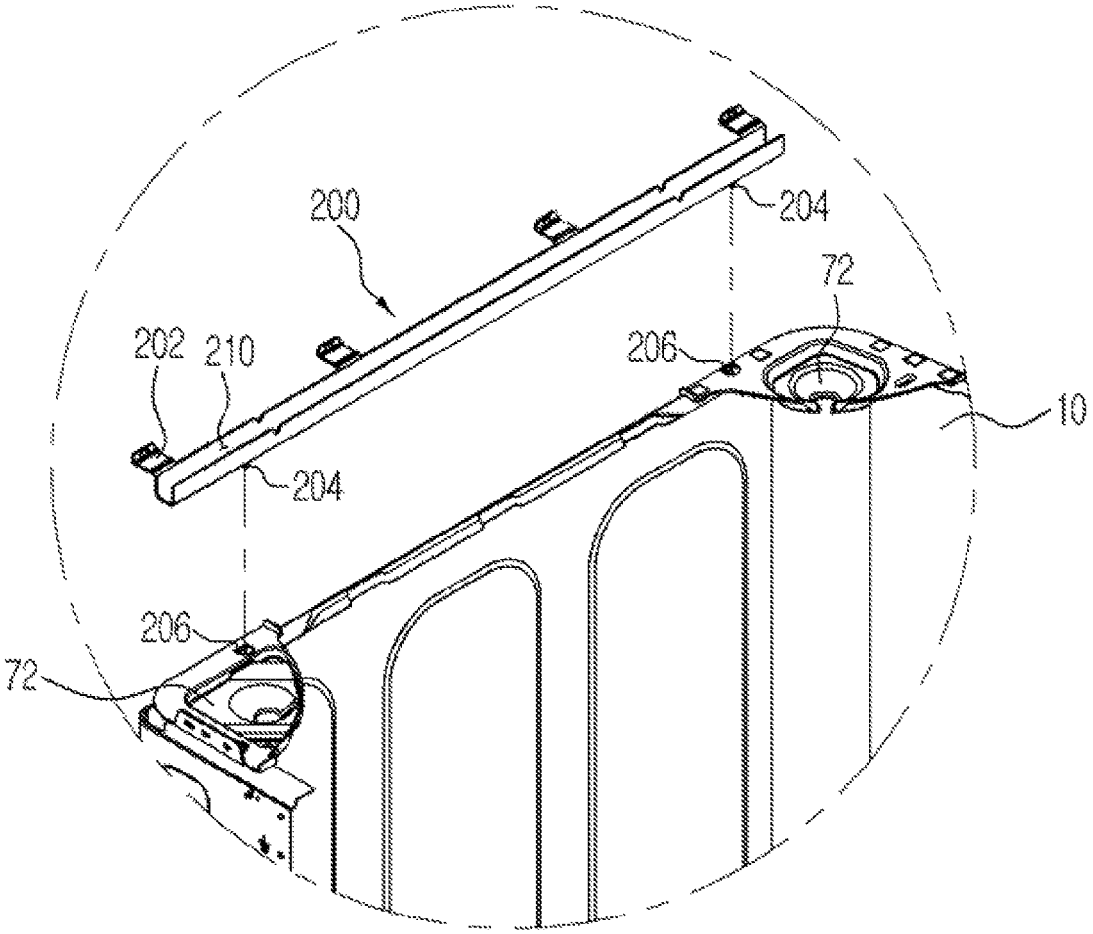
FIG. 3 is a view showing a guide coupled to the washing machine according to an embodiment of the disclosure.

FIG. 3 is a view showing a guide 200 coupled to the washing machine 1 according to an embodiment of the disclosure.

The washing machine 1 may include the guide 200 which defines a passage of the wire harness 100. The guide 200 may be installed at at least one upper edge of the casing 10 so as to be covered with the cover 40. As such, the guide 200 is not exposed to the outside of the completely assembled washing machine 1. That is, the guide 200 may be installed to one or more edges of the casing 10 coupled to the cover 40.

The guide 200 may define an elongated groove 210 into which the wire harness 100 may be inserted to extend in a longitudinal direction of the guide 200. As exemplarily shown in FIG. 3, the guide 200 may extend along a longitudinal length of an upper edge of the casing 10. For example, the longitudinal length may refer to a direction which corresponds to a front-to-back or back-to-front direction of the washing machine 1. A bottom surface of the guide 200, on which the wire harness 100 is seated, may be flat to allow the guide 200 to be fixed (secured) to the edge of the casing 10. Both lateral sides of the bottom surface of the guide 200 may be bent upward to surround the wire harness 100. As such, the wire harness 100 may be horizontally fixed (secured). For example, the lateral sides of the bottom surface of the guide 200 may be bent upward to be substantially perpendicular to the bottom surface of the guide 200.

To ensure that the wire harness 100 is stably fixed (secured) in the elongated groove 210, the guide 200 may include at least one fixing member 202. The fixing member 202 may be formed of a material that a worker (or machine) may easily bend when fixing the wire harness 100. That is, the fixing member 202 may be formed of a material that is easily deformable or flexible, for example. As exemplarily shown in FIG. 3, four fixing members 202 may be arranged in a longitudinal direction of the guide 200. For example, the four fixing members 202 may be arranged at a constant (regular) interval in a longitudinal direction of the guide 200. The wire harness 100 may be inserted into the elongated groove 210 and may be fixed without a risk of upward movement as the fixing members 202 are bent (e.g., manually or by machine) into the elongated groove 202. As mentioned above, the guide 200 may include four fixing members 202, however, this is only an example and the disclosure is not limited thereto. For example, the guide 200 may include one, two, three, or more than four fixing members.

The guide 200 may include at least one fitting member 204 to install the guide 200 to the casing 10. The casing 10 may include at least one fitting recess 206 corresponding to the at least one fitting member 204. As exemplarily shown in FIG. 3, a pair of fitting members 204 may protrude from both sides of a lower surface of the guide 200 so as to be fitted into the casing 10. The fitting recess 206, into which the fitting member 204 may be fitted, may be located proximate to the support rod receiver 72 located at a corner of the casing 10. That is, as shown in FIG. 3 for example, the guide 200 may extend from a front end of the casing 10 to a rear end of the casing 10. One fitting member 204 may be disposed at one end of the guide 200 and another fitting member 204 may be disposed at the other end of the guide 200. For example, as shown in FIG. 3, fitting recesses 206 may be disposed in respective corner brackets in which respective support rod receivers 72 are disposed.

Figure 4:
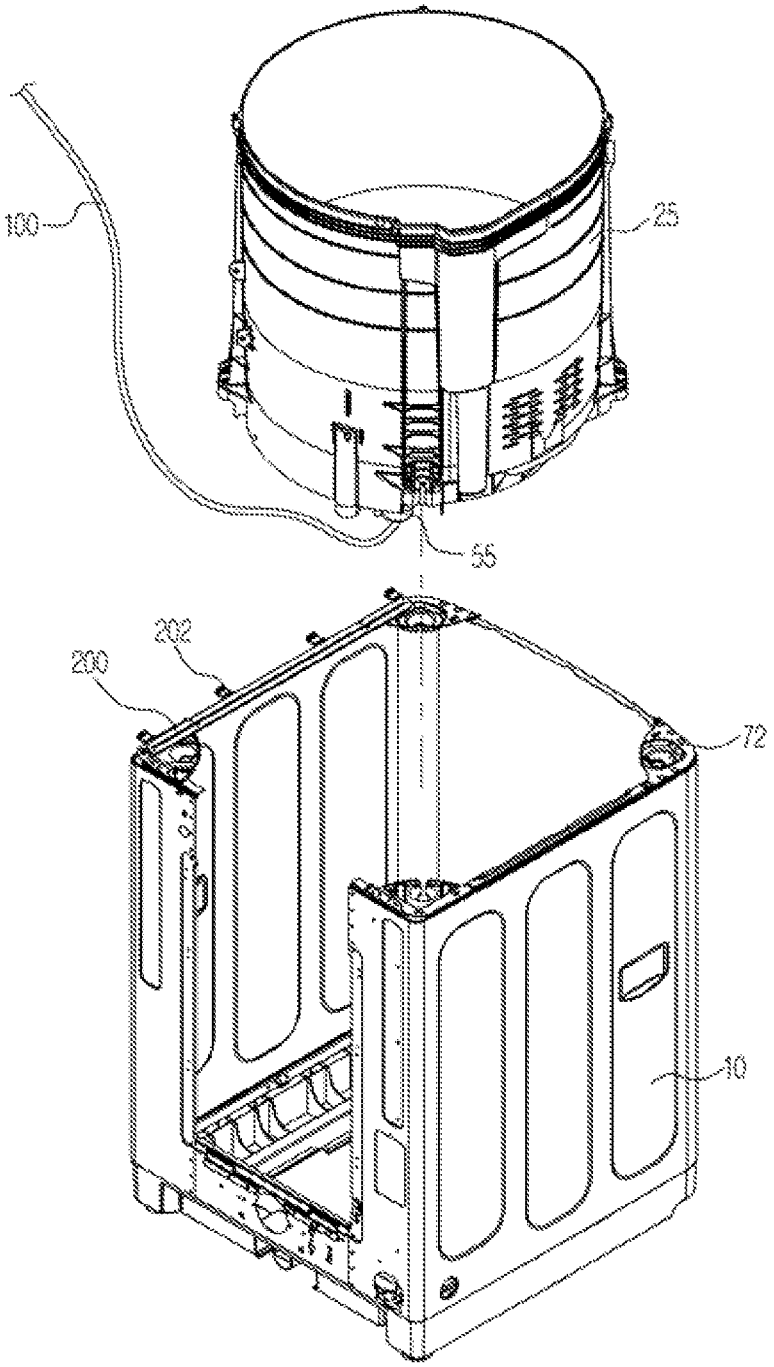
FIG. 4 is a view showing coupling of a casing and a tub structure included in the washing machine according to an embodiment of the disclosure.

FIG. 4 is a view showing coupling of the casing 10 and the tub structure 25 included in the washing machine 1 according to an embodiment of the disclosure. The lower electric component 55 may be installed to a lower surface of the tub structure 25 before the tub structure 25 is installed within the casing 10. The tub structure 25 may be installed within the casing 10 in a state in which the lower electric component 55 installed to the tub structure 25 is coupled to one side of the wire harness 100.

Figure 5:
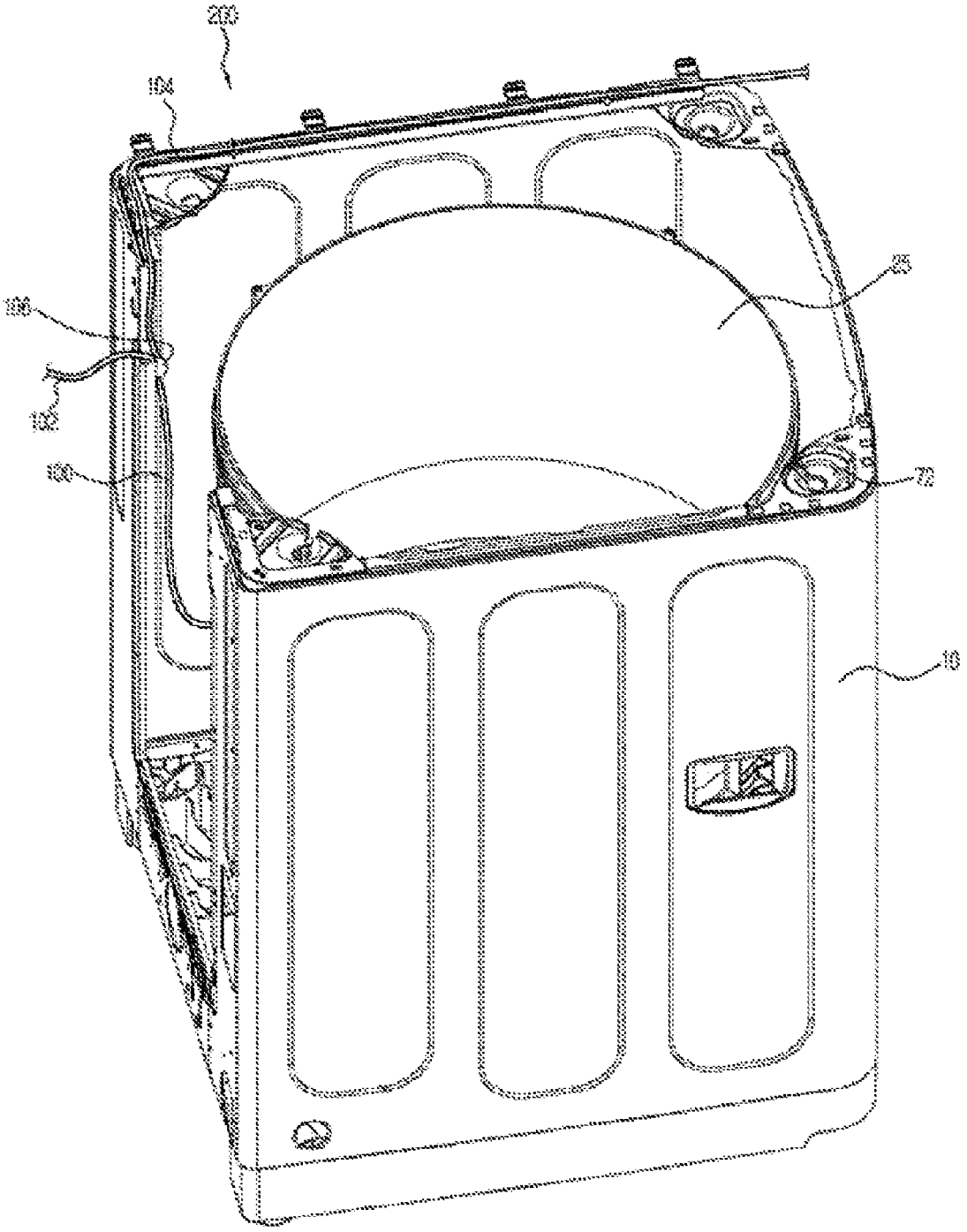
FIG. 5 is a view showing a wire harness seated in the guide of the washing machine according to an embodiment of the disclosure.
Figure 6:
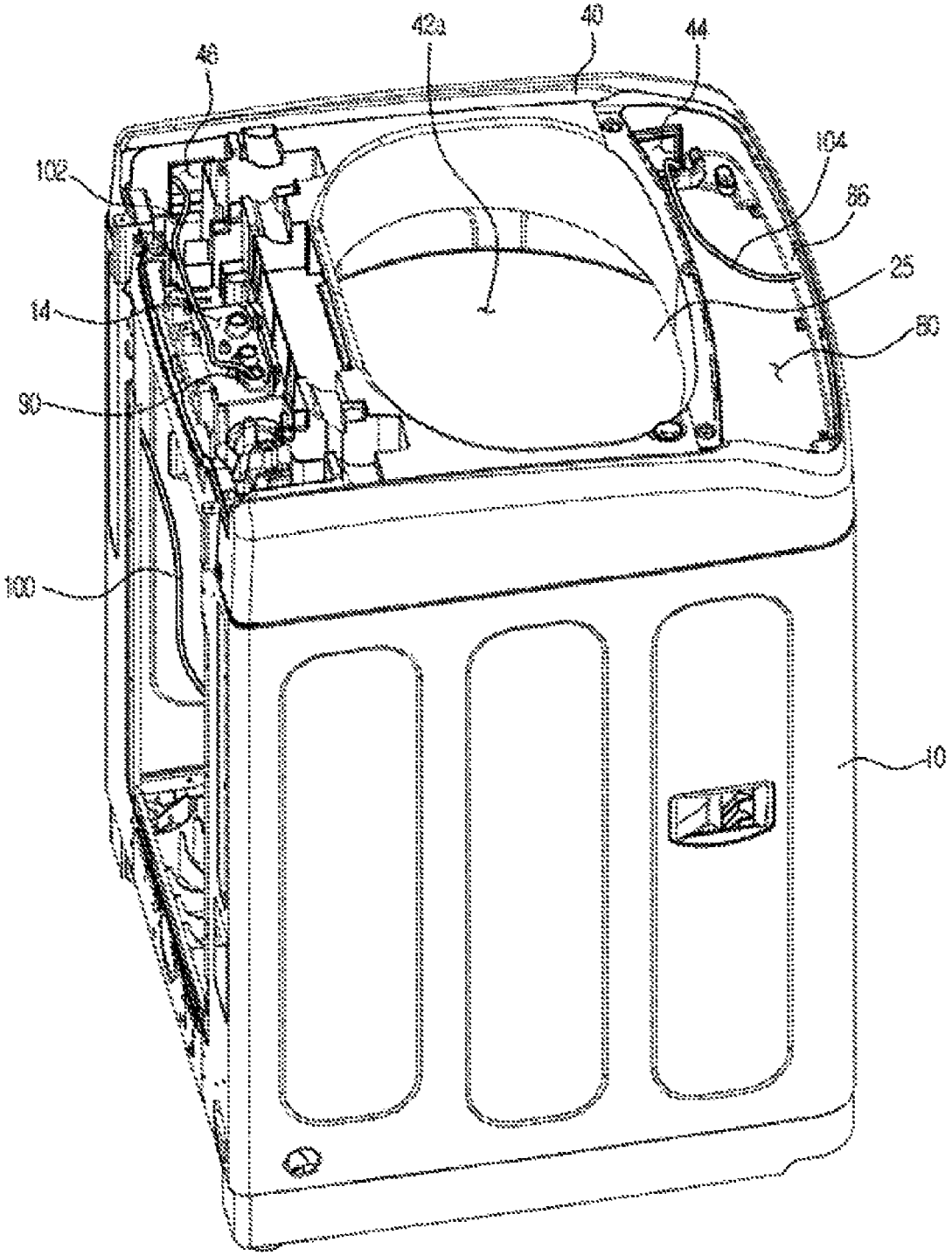
FIG. 6 is a view showing coupling of the wire harness and respective electric components of the washing machine according to an embodiment of the disclosure.

FIG. 5 is a view showing the wire harness 100 seated in the guide 200 of the washing machine 1 according to an embodiment of the disclosure, and FIG. 6 is a view showing coupling of the wire harness 100 and respective electric components of the washing machine 1 according to an embodiment of the disclosure.

The wire harness 100, one side of which is coupled to the lower electric component 55, extends to the top of the casing 10. The casing 10 may include a holder 106 located at the top of an inner surface thereof to catch the wire harness 100 extending from the bottom of the casing 10. The holder 106 may take the form of a loop attached to the top of the inner surface of the casing 10 to surround the wire harness 100.

The wire harness 100 may extend upward through the holder 106 and may be divided into a first wire 102 and a second wire 104. The first wire 102 may be coupled to the upper electric component 90 located in the rear region of the cover 40, and the second wire 104 may be coupled to the circuit board 86 installed in the control panel 80 provided at a front portion of the cover 40. That is, one side of the wire harness 100 may be coupled to the lower electric component 55, and the other side of the wire harness 100 may be coupled to the upper electric component 90 and the control panel 80. For example, as shown in FIG. 5, it may be seen that wire harness 100 extends upward from the lower electric component 55 at a rear side of the washing machine 1, and at least one wire from the wire harness 100 runs via guide 200 (disposed at an upper edge of the washing machine 1) from the rear side of the washing machine 1 to the front side of the washing machine 1.

The cover 40 may include a first opening 46 at the rear side of the opening 42*a* and a second opening 44 at the front side of the opening 42*a*. The first opening 46 and the second opening 44 may be proximate to both sides of the guide 200. That is, as shown in FIG. 3 for example, the guide 200 may extend from a front end of the casing 10 to a rear end of the casing 10. One end of the guide 200 may be disposed adjacent to the first opening 46 and the other end of the guide 200 may be disposed adjacent to the second opening 44. The first wire 102 may pass through the first opening 46 and may be inserted into the electric component receptor 14 to thereby be coupled to the upper electric component 90. The second wire 104 may extend along the guide 200 and pass through the second opening 44 to thereby be coupled to the control panel 80.

An assembly method of the washing machine 1 will be described hereinafter with reference to FIGS. 3 to 6.

The guide 200 may be installed to at least one edge of the open top side of the casing 10 defining the external appearance of the washing machine 1. The fitting members 204 provided at the guide 200 may be inserted into the fitting recesses 206 formed in the upper edge of the casing 10 to fix the guide 200 to the casing 10.

The tub structure 25, to which the lower electric component 55 connected to the wire harness 100 is installed, is provided. The tub structure 25 may be inserted into the open top side of the casing 10 and installed within the casing 10 such that the wire harness 100, one side of which is connected to the lower electric component 55, extends upward of the casing 10.

The wire harness 100, extending from the lower electric component 55 to the top of the casing 10, may be fixed to the top of a rear surface of the casing 10 by the holder 106. The fixed wire harness 100 may be divided into the first wire 102 coupled to the upper electric component 90 located in the rear region of the cover 40 and the second wire 104 extending to a front surface of the casing 10 along the guide 200.

The second wire 104 may extend to the front surface of the casing 10 along the guide 200 installed to at least one upper edge of the casing 10. To this end, the second wire 104 may be inserted into the elongated groove 210 of the guide 200 and may be fixed to the guide 200 by the fixing members 202.

The cover 40 may be coupled to the open top side of the casing 10 to cover the guide 200. The first wire 102 and the second wire 104 pass through the first opening 46 and the second opening 44 formed in the cover 40. That is, the first wire 102 may pass through the first opening 46 and may be coupled to the upper electric component 90. The second wire 104 may pass through the second opening 44 may be coupled to the circuit board 86 which may be installed at the rear surface of the control panel 80.

In an alternative embodiment, the guide 200 may be installed such that the guide 200 extends along the longitudinal direction of an edge of the open top first side of the casing 10, and may also partially extend along one or more sides of the casing 10 which are perpendicular to the first side of the casing 10, such that the guide 200 is formed in a substantially "L" shape or "C" shape. If the guide 200 is formed to extend along more than one side of the casing, additional fixing members and/or fitting members and corresponding fitting recesses may be provided as necessary to ensure the guide 200 is securely attached to the casing and the wire harness 100 is secured in the guide 200.

In an alternative embodiment, the wire harness 100 may extend upward on an opposite side of the washing machine 1 (i.e., a front side of the washing machine). The wire harness 100 may extend upward through a holder and may be divided into a first wire and a second wire. The first wire may be coupled to the circuit board 86 installed in the control panel 80 provided at a front portion of the cover 40, and the second wire may be coupled to the upper electric component 90 located in the rear region of the cover 40. That is, one side of the wire harness 100 may be coupled to the lower electric component 55, and the other side of the wire harness 100 may be coupled to the upper electric component 90 and the control panel 80.

As is apparent from the above description, through use of an integrated wire harness connecting a control panel and an electric component below a tub to each other, it may be possible to reduce manufacturing costs and to prevent fire in a washing machine due to insulation breakage.

Further, assembly efficacy of the washing machine may be enhanced by installing the integrated wire harness using a guide.

Although the embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A washing machine, comprising:

a casing;

a tub installed within the casing;

a cover coupled to a top of the casing, the cover having an opening;

a control panel attached to a front surface of the cover to enable selection of a washing mode;

a lower electric component located below the tub;

an integrated wire harness having one side coupled to the control panel and the other side coupled to the lower electric component to transmit an electrical signal; and a guide installed along an upper edge of the top of the casing and having an elongated groove extending in a front to rear direction of the washing machine such that at least a portion of the integrated wire harness is inserted into and extends along the elongated groove from a front side of the washing machine to a rear side of the washing machine.

2. The washing machine according to claim 1, wherein an upper electric component is located in a rear region of the cover, the control panel includes an input unit located at a front surface thereof and a circuit board located at a rear surface thereof to control an operation of the washing machine via manipulation of the input unit, and the one side of the integrated wire harness includes a first wire coupled to the upper electric component and a second wire coupled to the circuit board, and the other side of the integrated wire harness is coupled to the lower electric component.

3. The washing machine according to claim 2, wherein the cover includes a first through-hole disposed at a rear side of the opening such that the first wire is coupled to the upper electric component by passing through the first through-hole, and a second through-hole disposed at a front side of the opening such that the second wire is coupled to the control panel by passing through the second through-hole.

4. The washing machine according to claim 3, wherein the integrated wire harness extends from the lower electric component to the top of the casing, and the casing includes a holder to fix the integrated wire harness to a top of an inner surface of the casing.

5. The washing machine according to claim 4, wherein the integrated wire harness is divided into the first wire and the second wire at the holder, and the first wire passes through the first through-hole to thereby be coupled to the upper electric component, and the second wire extends along the elongated groove of the guide and passes through the second through-hole to thereby be coupled to the control panel.

6. The washing machine according to claim 1, wherein the cover is coupled to the top of the casing so as to cover the guide.

7. The washing machine according to claim 6, wherein the elongated groove includes a bottom surface into which the at least the portion of the integrated wire harness is seated and opposite sides bent upward from the bottom surface to surround the at least the portion of the integrated wire harness.

8. The washing machine according to claim 7, wherein the guide includes at least one fixing member to fix the at least the portion of the integrated wire harness inserted into the elongated groove in a vertical direction of the washing machine.

9. The washing machine according to claim 6, wherein the guide includes at least one fitting member located at a lower surface of the guide to install the guide to the casing.

10. The washing machine according to claim 9, wherein the casing includes at least one fitting recess disposed in an upper corner of the casing such that the at least one fitting member is inserted into the at least one fitting recess.

11. The washing machine according to claim 2, wherein the lower electric component includes a drive device and the upper electric component includes a water supply device.

12. A washing machine, comprising:

a casing which forms an external appearance of the washing machine and having an open top side;

a guide installed along an upper edge of the top side of the casing and having an elongated groove extending in a front to rear direction of the washing machine such that at least a portion of a wire extends along the elongated groove from a front side of the washing machine to a rear side of the washing machine; and a cover coupled to cover the top side of the casing so as to cover the guide and the top side of the casing.

13. The washing machine according to claim 12, wherein the cover includes:

a door to open and close an opening provided in a central upper portion of the cover, a first through-hole disposed at a rear side of the door so as to be located proximate to one side of the guide, and a second through-hole disposed a front side of the door so as to be located proximate to the other side of the guide.

14. The washing machine according to claim 13, further comprising:

a tub installed within the casing; and a wire harness having one side coupled to a lower surface of the tub and the other side extending to the one side of the guide proximate to the first through-hole.

15. The washing machine according to claim 14, wherein the wire harness includes a first wire passing through the first through-hole and a second wire extending along the elongated groove of the guide and passing through the second through-hole.

16. The washing machine according to claim 15, wherein the guide includes at least one fixing member to fix the second wire to the guide in a vertical direction of the washing machine.

17. The washing machine according to claim 12, wherein the guide includes fitting members provided at both sides thereof, and fitting recesses are disposed in the upper edge of the top side of the casing such that the fitting members are inserted respectively into the fitting recesses.

18. An assembly method of a washing machine, the washing machine comprising a casing defining an external appearance of the washing machine, and a tub disposed in the casing, the assembly method comprising:

connecting one side of a wire harness to a lower electric component installed to a lower surface of the tub;

installing the tub within the casing through an open top side of the casing;

extending the wire harness, connected to the lower electric component, to a top of the casing, and then extending the wire harness to a front surface of the casing along an elongated groove of a guide installed along an upper edge of the top side of the casing;

coupling a cover having an opening to the top side of the casing; and coupling the other side of the wire harness, extending to the front surface of the casing, to a control panel located at the cover, wherein the elongated groove of the guide extends in a front to rear direction of the washing machine such that at least a portion of the wire harness extends along the elongated groove from a front side of the washing machine to a rear side of the washing machine.

19. The assembly method according to claim 18, further comprising:

fixing the wire harness, extending from the lower electric component to the top of the casing, to a top of a rear surface of the casing.

20. The assembly method according to claim 19, further comprising:

dividing the wire harness, fixed to the top of the rear surface of the casing, into a first wire coupled to an upper electric component located in a rear region of the cover, and a second wire extending along the elongated groove of the guide to the front surface of the casing.

21. The assembly method according to claim 18, further comprising:

fixing the wire harness, extending along the elongated groove of the guide to the front surface of the casing, to the guide via at least one fixing member installed to the guide.

22. The assembly method according to claim 18, further comprising:

fitting at least one fitting member included in the guide into at least one fitting recess disposed in the upper edge of the top side of the casing to install the guide to the upper edge of the top side of the casing.

* * * * *